US007086187B2

(12) United States Patent
Bandak

(10) Patent No.: US 7,086,187 B2
(45) Date of Patent: Aug. 8, 2006

(54) ADVERTISING DISPLAY SYSTEM AND METHOD

(76) Inventor: Husam Yousef Bandak, 4241 Marston La., Santa Clara, CA (US) 95054

( * ) Notice: Subject to any disclaimer, the term of this patent is extended or adjusted under 35 U.S.C. 154(b) by 0 days.

(21) Appl. No.: 11/066,947

(22) Filed: Feb. 25, 2005

(65) Prior Publication Data

US 2006/0090381 A1 May 4, 2006

Related U.S. Application Data

(60) Provisional application No. 60/624,329, filed on Nov. 3, 2004.

(51) Int. Cl.
*G09F 19/14* (2006.01)

(52) U.S. Cl. ..... 40/453; 40/605; D11/131

(58) Field of Classification Search ..... 40/453, 40/427, 124.08, 605, 624, 742, 584; 434/82, 434/91, 96; D11/131; 52/311.1, 311.2
See application file for complete search history.

(56) References Cited

U.S. PATENT DOCUMENTS

| | | | | | |
|---|---|---|---|---|---|
| 386,883 | A * | 7/1888 | Heinemann | 40/453 |
| 2,143,235 | A * | 1/1939 | Bassett | 472/75 |
| 3,080,668 | A * | 3/1963 | Reali | 40/476 |
| 4,430,825 | A * | 2/1984 | Leboeuf | 446/101 |
| 5,522,754 | A * | 6/1996 | Hanson | 446/144 |
| D417,168 | S * | 11/1999 | Hollingsworth | D11/121 |
| 6,041,533 | A * | 3/2000 | Lemmond, Jr. | 40/584 |
| 6,078,701 | A * | 6/2000 | Hsu et al. | 382/294 |
| 6,133,892 | A * | 10/2000 | Borgwardt | 345/1.3 |
| 6,553,699 | B1 * | 4/2003 | Edmunds et al. | 40/624 |
| 6,891,561 | B1 * | 5/2005 | Achituv et al. | 348/36 |
| 2004/0134107 | A1 * | 7/2004 | Hinterkeuser | 40/584 |
| 2005/0252058 | A1 * | 11/2005 | Shaked et al. | 40/798 |

OTHER PUBLICATIONS

Photograph of the set of HBO's 1998 miniseries "From the Earth to the Moon," http://web.archive.org/web/20030209171823/http://www.mkmillay3d.com/user/HBO.jpg, image captured Feb. 9, 2003.*

Millay Studios—Portfolio, Millay Studios website, http://web.archive.org/web/20020803101030/http://www.mkmillay3d.com/services.html, Aug. 3, 2002.*

* cited by examiner

*Primary Examiner*—Gary C. Hoge

(57) ABSTRACT

A display and an associated method of making the display are disclosed. The display is characterized by one or more partial image carriers, each having mounted thereon a partial image, and arranged at predetermined locations and orientations such that they cooperatively define a desired transitory complete image design or logo when viewed by an observer passing by a predetermined viewing area relative to the display. Several embodiments are disclosed which achieve the desired result. One embodiment includes a fragmented arrangement of multiple partial image carriers where the partial image carriers may be constructed from two-dimensional flat plates or three-dimensional solid objects or a combination of both. Another embodiment utilizes partially transparent partial image carriers.

17 Claims, 6 Drawing Sheets

ADVERTISING DISPLAY SYSTEM AND METHOD

CROSS REFERENCE TO RELATED APPLICATIONS

The present invention claims priority under 35 U.S.C. 119(e) from provisional patent application Ser. No. 60/624,329, entitled "Fragmented, Non-Electrical, Non-Electronic, Advertising Billboard or Display", filed on Nov. 3, 2004, the disclosure of which is herein incorporated by reference in its entirety.

FIELD OF THE INVENTION

The present invention relates generally to advertising media employed to capture the attention of observers in motion and more particularly to a display having a plurality of partial image carriers, a plurality of partial images mountable to the partial image carriers wherein the partial images cooperatively define a complete image upon being viewed from a predetermined viewing area.

BACKGROUND OF THE INVENTION

Competition among advertisers for the attention of prospective customer observers is intense. Advertisers face three major problems. First, how can they stand out among all of the competing advertiser's clutter within the observer's field of vision? Many potential observers do their best to "tune out" the cacophony of usual displays vying for their attention. Second, once noticed, how can advertisers hold observer attention long enough to impart their message? Observers who are paying attention are usually time sharing this attention among the various presentations to determine if there is one of interest. And third, how can advertisers make a lasting impression of their message upon the observer? There is therefore a need to differentiate the presentation so it will be memorable.

Flat displays and billboards have been the norm in advertising for many years. Recent improvements have increased space efficiency and the ability to "catch the observer's eye". Lenticular lenses and pleated displays allow more than one image to be presented from the same advertising space. A problem associated with these lenses is that of observer attention capture. There is usually no mechanism to precapture the observer's attention prior to delivery of the message. As a result, the message may be missed when the observer is not focused in advance. Three-dimensional protrusions from the flat billboard seek to garner observer attention. But, as the observer passes by today's typical advertisements, they are usually presented with boring rectangular flat billboards carrying too much information resulting that most people "tune them out".

There is therefore a need in the art for a new and novel display concept that is eye-catching, curious, artistic, informative and pleasing to look at. The display should inspire observer curiosity by its presentation method and thereby achieve increased observer attention span and post exposure message retention.

The same concept could be employed by other advertising media such as Television, CD Rom advertising and DVD advertising since the above concept could be captured as a 3D animation which is one of the ways this concept has been developed for marketing purposes.

SUMMARY OF THE INVENTION

In accordance with one aspect of the invention, a display includes a plurality of partial image carriers, at least one of the plurality of partial image carriers being disposed in a plane having an orientation different from an orientation of the remaining partial image carriers, and wherein each partial image carrier carries a partial image which cooperatively defines a complete image upon being viewed from a predetermined viewing area. The partial images are either permanently or releasably mounted to the partial image carriers by standard fixing means. The partial image carriers are constructed from either two-dimensional flat plates or three-dimensional objects or a combination of both. The partial image carriers may be placed at predetermined locations and oriented in specific directions such that when observed from a predetermined viewing area, the plurality of partial images cooperatively define the complete image. The complete image may be opaque to its background or it may only provide the outline of the complete image and otherwise be relatively transparent to its background.

In accordance with another aspect of the invention, a display utilizes a partially transparent image outline carriers that has been shaped into a two-dimensional or three-dimensional form to achieve a similar effect.

There has been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended herein.

In this respect, before explaining at least one embodiment of the invention in detail, it is to be understood that the invention is not limited in its application to the details of design and to the sequence of steps and processes set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other systems and methods for carrying out the several purposes of the present invention. It is important, therefore, that the claims be regarded as including such equivalent systems, methods, and structures insofar as they do not depart from the spirit and scope of the present invention.

DETAILED DESCRIPTION OF THE INVENTION

Figure 1:
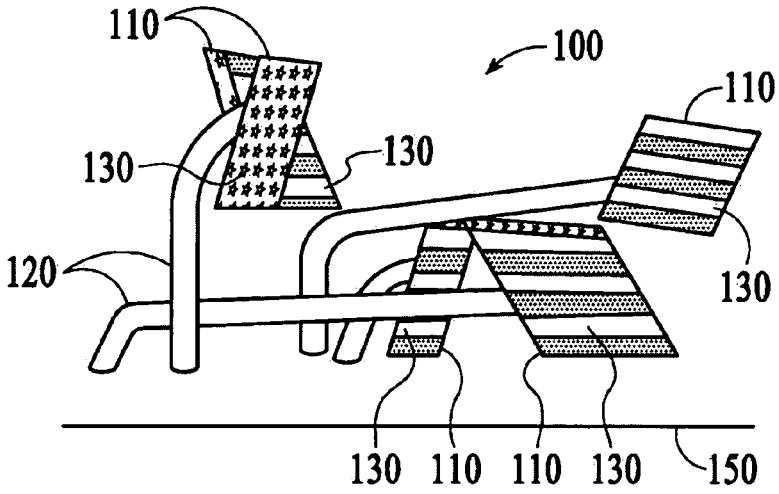
FIG. 1 is an elevation view from a left side approach of a display in accordance with the present invention.
Figure 2:
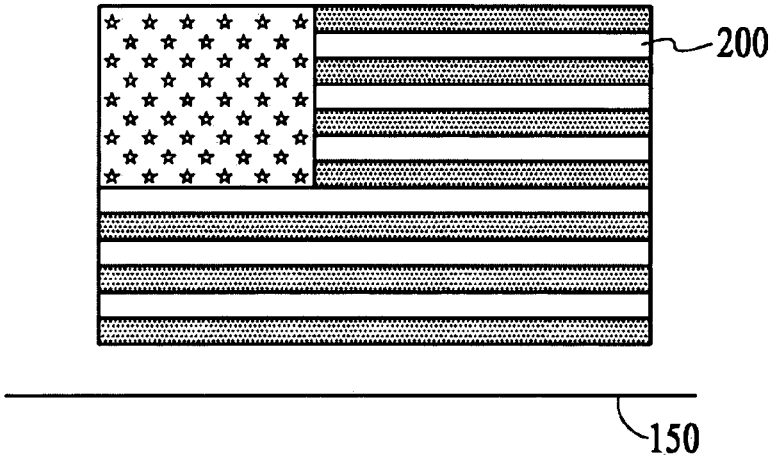
FIG. 2 is a front elevation view of the display of FIG. 1 showing a complete image upon being viewed from a predetermined viewing area in accordance with the present invention.
Figure 3:
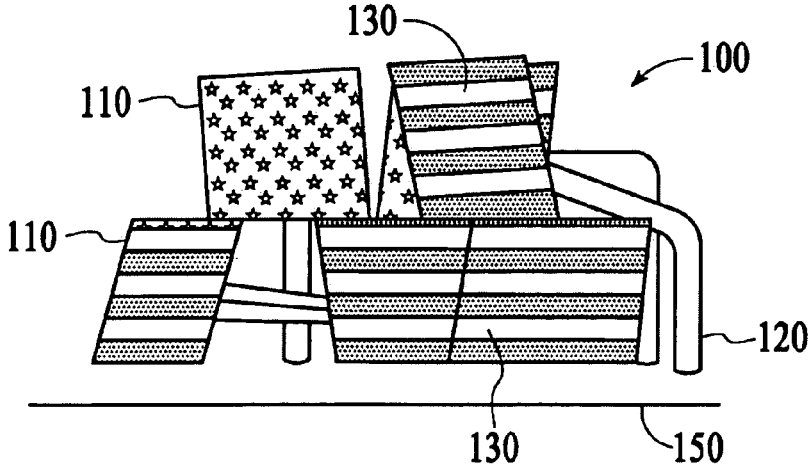
FIG. 3 is an elevation view from a right side approach of the display of FIG. 1 in accordance with the present invention.

With reference to FIGS. 1–3 a display generally designated 100 includes a plurality of partial image carriers 110 which may be supported either on or above the ground 150 by conventional support means such as posts 120. Each partial image carrier 110 may have mounted thereto a partial image 130. As shown in FIG. 1, when viewed from a left hand side, the plurality of partial images 130 appear as irregular artistic shapes having an unusual orientation. A similar appearance may be observed from a right hand side as shown in FIG. 3. The plurality of partial images 130 may cooperatively define a complete image 200 upon being viewed from a predetermined viewing area. In a preferred embodiment, the predetermined viewing area may be a location wherein an observer is located at a location 90 degrees from a plane of the complete image 200.

Figure 4:
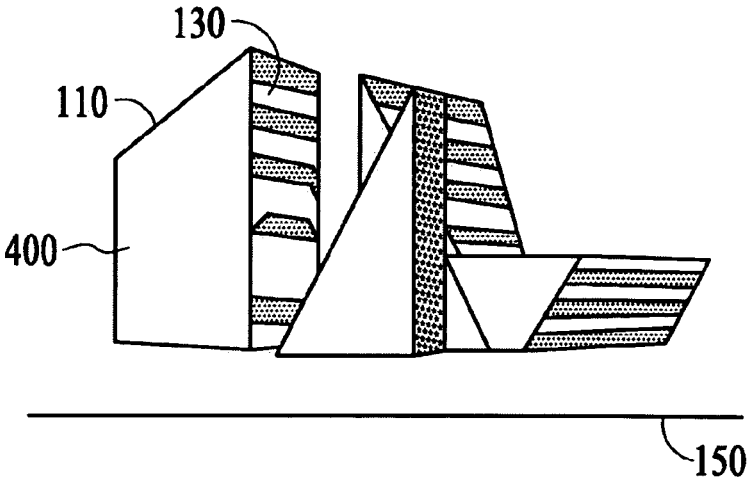
FIG. 4 is an elevation view from a left side approach of an alternative embodiment of the display in accordance with the present invention.
Figure 5:
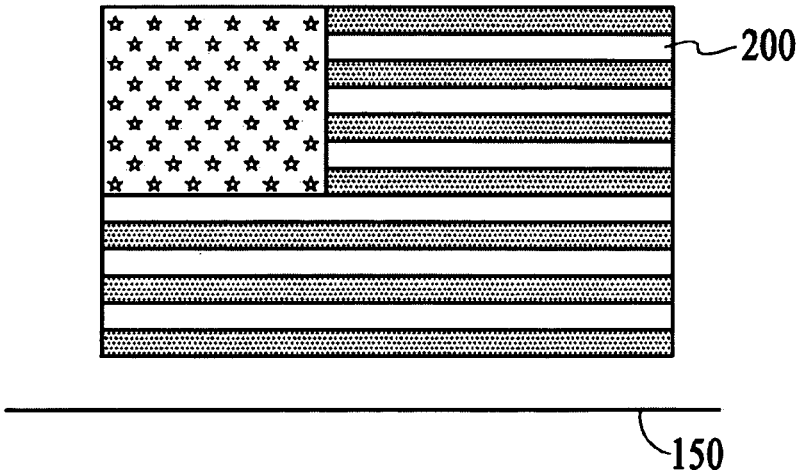
FIG. 5 is a front elevation view of the display of FIG. 4 showing a complete image upon being viewed from a predetermined viewing area in accordance with the present invention.
Figure 6:
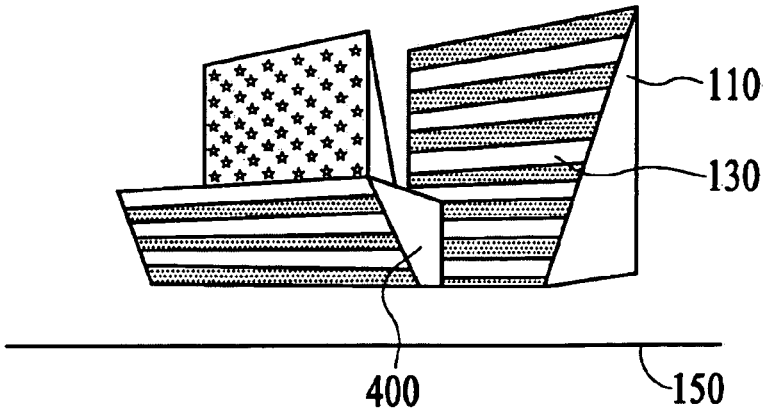
FIG. 6 is an elevation view from a right side approach of the display of FIG. 4 in accordance with the present invention.
Figure 7:
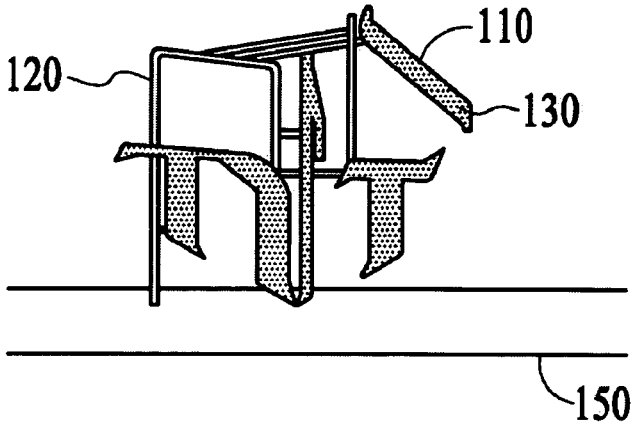
FIG. 7 is an elevation view from a left side approach of another alternative embodiment of the display in accordance with the present invention.
Figure 8:
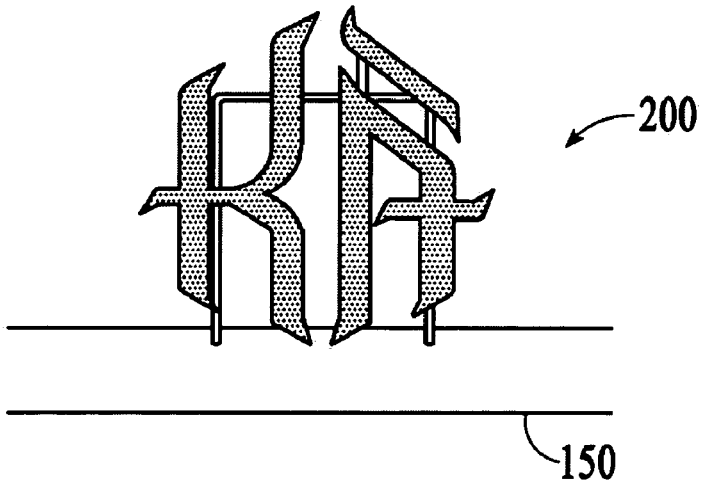
FIG. 8 is a front elevation view of the display of FIG. 7 showing a complete image upon being viewed from a predetermined viewing area in accordance with the present invention.
Figure 9:
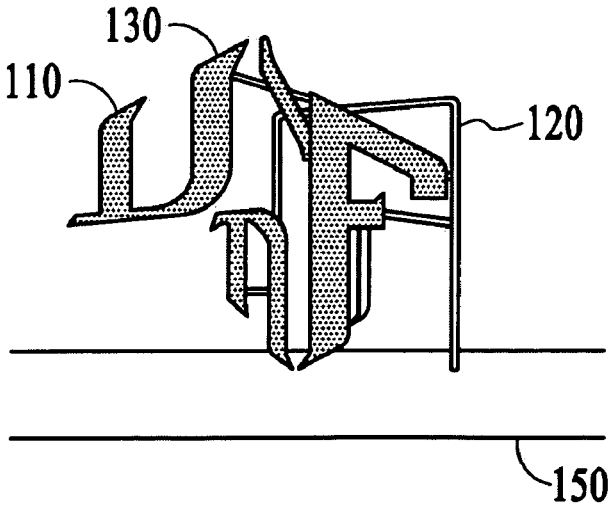
FIG. 9 is an elevation view from a right side approach of the display of FIG. 7 in accordance with the present invention.

The plurality of partial images 130 may be either permanently or releasably mounted to the partial image carriers 110 by standard fixing means. The partial image carriers 110 may be constructed from either two-dimensional flat plates as shown in FIGS. 1–3 or three-dimensional objects 400 as shown in FIGS. 4–6 or a combination of both. The complete image 200 may be opaque to its background as shown in FIGS. 1–6 or it may provide an outline of the complete image 200 (such as the design "KA" registered by Cirque du Soleil shown in FIG. 8) and otherwise be relatively transparent to its background as shown in FIGS. 7–9.

In an aspect of the present invention, a combination of two-dimensional flat plates and three-dimensional objects may be used depending on the artistic requirements of the advertising display 100. Each of the above carriers could also be fixed from a back in the desired location by adjustable means using standard construction techniques in order to be able to reorient the partial image carriers 110 for future changes in design.

Figure 10:
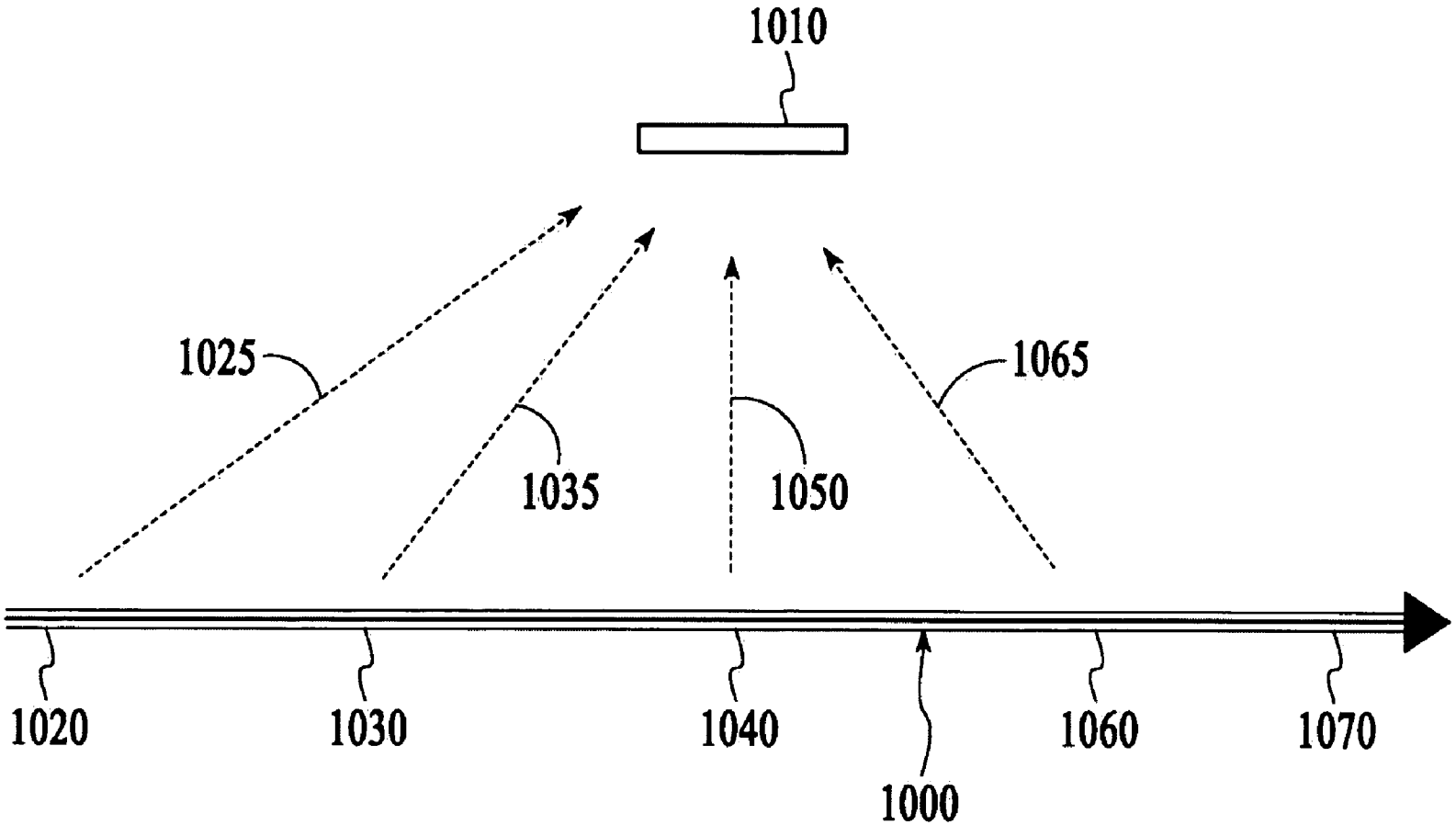
FIG. 10 is a schematic representation of a succession of relationships that occur between an observer in motion passing before the display in accordance with the present invention.

FIG. 10 illustrates a general succession of relationships that may occur during the encounter by an observer in motion along a path 1000 passing by a front of a display 1010 from left to right. The encounter may begin at a point 1020, which may be as much as 90 degrees off an intended axis of viewing 1050. From this location 1020, the observer's sight line 1025 to the display 1010 would yield little information about the existence of the display 1010 or its message.

As the observer continues along path 1000 from the point 1020 to an intermediate approach point 1030 the observer will become initially aware of the display and its image carriers. Upon arrival at an intermediate approach point 1030, the observer should be fully aware of the existence of the display 1010 and be curious as to what it might be. The non-traditional construction technique may inhibit immediate rejection as "just more advertising". The positioning of the partial image carriers 110 may be chosen to place this intermediate approach point 1030 at a nominal 45 degrees off the intended viewing axis 1050 but may generally be located from about 60 to about 30 degrees off the intended viewing axis 1050. Factors such as the relative speed of the observer, distance of the observer from the display 1010, local obstructions to sight lines, and others may influence this choice. FIG. 1 illustrates an elevation view of an oblique image of a display 100 as may be seen by an observer along a sight line 1035 from the intermediate approach point 1030.

As the observer continues along path 1000 from the intermediate approach point 1030 to a central point 1040 the observer may become fully aware of the display 1010. Observer curiosity may increase as the display 1010 assembles itself into a coherent message. Upon arrival at the central point 1040, the observer may be fully aware of the display 100 and its message conveyed by the complete image 200. The positioning of the partial image carriers 110 may be chosen to place this central viewing point on an intended viewing axis 1050 but may generally be located over a range from about minus 15 to about plus 15 degrees off the intended viewing axis 1050. Factors such as the relative speed of the observer, distance of the observer from the display 1010, local obstructions to sight lines, desired message display time, and others may influence this choice. FIG. 2 illustrates an elevation view of this perpendicular image of display 100 showing the complete image 200 as may be seen by the observer along sight line 1050 from the central point 1040.

As the observer continues along path 1000 from the central point 1040 to an intermediate departure point 1060 the observer may remain engaged as the message begins to disassemble itself. Upon arrival at the intermediate departure point 1060, the observer may be trying to mentally maintain the now disappearing message. The positioning of the partial image carriers 110 may be chosen to place this intermediate departure point 1060 at a nominal 45 degrees off the intended viewing axis 1050 but may generally be located over a range from about 30 to about 60 degrees off the intended viewing axis 1050. Factors such as the relative speed of the observer, distance of the observer from the display, local obstructions to sight lines, and others may influence this choice. FIG. 3 illustrates an elevation view of this oblique image of the display 100 as may be seen by an observer along a sight line 1065 from the intermediate departure point 1060.

As the observer continues along path 1000 from the intermediate departure point 1060 to a final point 1070 the observer may see the display 1010 and message disappear as the disassembly process completes. Upon arrival at the final point 1070, the observer may be left with a strong mental impression of the message due to its unique presentation.

The display 1010 may be simultaneously effective for observers passing in either or both directions.

Figure 11:
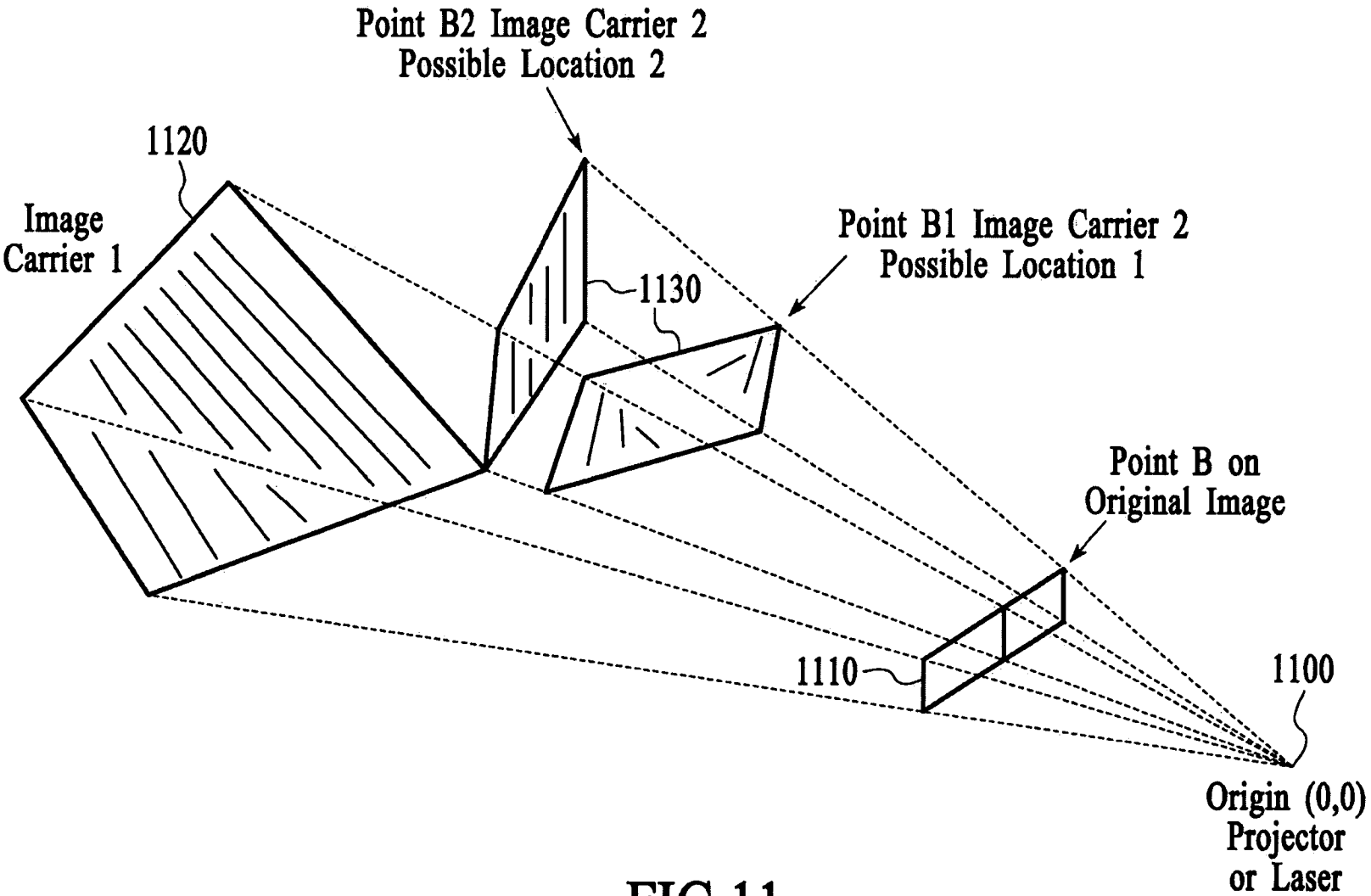
FIG. 11 is a schematic representation of a method of constructing the display in accordance with the present invention.

Implementation of the present invention may be accomplished in a straightforward manner using any of several simple construction techniques available. As shown in FIG. 11, one implementation method may utilize a projector 1100 that may project a picture of the complete image 200 using a slide transparency 1110. After the picture is projected, the desired number of partial image carriers 110 may be placed in the path of the projected image. Two or more partial image carriers 110 may be used based on how complex the designer of the advertising system would like the system to be. Each partial image carrier 110 could be placed at any desired location and at any desired orientation. Two partial image carriers 1120 and 1130 are shown with partial image carrier 1130 shown disposed in alternate positions. The projected image on each such partial image carrier 1120 and 1130 would dictate how that part of the image is traced on each partial image carrier 1120 and 1130. For example, a point B on the slide transparency 1110 may be transferred to any possible location on partial image carrier 1130 as point B1 on possible location 1 or point B2 on possible location 2 for carrier 1130. Once the partial images are projected on partial image carriers 1120 and 1130, then the partial images could either be painted on the carriers 1120 and 1130 themselves or traced or reproduced by any standard imaging process using standard advertising material.

As shown in FIG. 11, if a partial image carrier is desired to be of a three-dimensional shape, the same exact procedure is utilized, but instead of locating four points, one would locate the rest of the corners of the 3D shape. As shown in the FIG. 11, the volume between the two suggested locations of partial image carrier 1130 could all be considered as one possible three dimensional carrier with the front face of such 3D object carrying the desired partial image. The possibilities of location and design of such 3D carriers are infinite. Techniques utilized for constructing two-dimensional carriers are applicable to the single facet of the three-dimensional carrier facing the observer. The remaining facets of the three-dimensional carriers are available for use as the artistic design requires. The extra facets will essentially disappear from sight as the observer reaches the intended viewing area. In the case of transparent or outline complete images such as shown in FIGS. 7–9, the same techniques may be applied to the individual complete image elements.

The choices of number of partial image carriers 110 and relative positioning and orientation are very flexible and essentially unlimited. They will generally be a function of the intended artistic effect to be experienced by the observer as the partial images 130 visually assemble into the complete image 200 as the viewer moves towards the intended viewing area. Additional factors such as the complexity of the message contained in the complete image 200, distance between display and observer, background, cost, and display space available will also influence these choices.

Laser beams may also be utilized to achieve the same outcome since laser beams shoot in straight lines. When the laser is directed through the complete image 200, the beam would transpose the location of any desired point on the edges of the complete image 200 or anywhere within the complete image 200 onto the corresponding partial image carrier 110.

Figure 12:
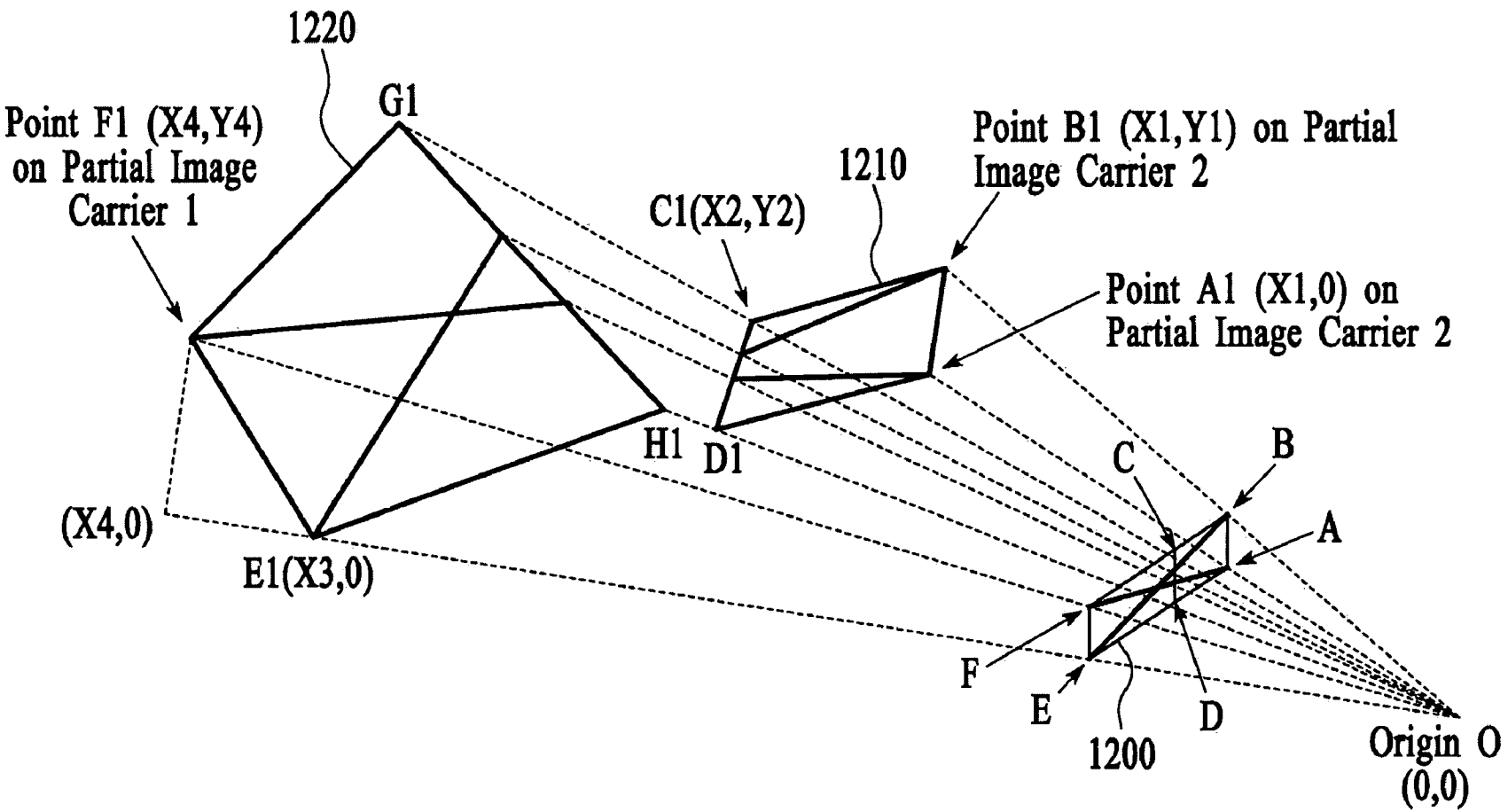
FIG. 12 is a schematic representation of a method of constructing a display having a complete image of the letter "X" using two partial image carriers.

A further alternative method of construction may include the use of 3D Computer Aided Design CAD® or any other computer design software. As shown in FIG. 12, for example, the complete image 1200 is chosen to be the letter "X" on a rectangle. After the final image 1200 is drawn, the desired number of partial image carriers is chosen based on the artistic design requirements mentioned above. For simplicity two partial image carriers 1210 and 1220 are shown, but the same method could be used for any number of partial image carriers 110. For simplicity of explanation, the complete image 1200 is divided into two parts corresponding to the two partial image carriers 1210 and 1220. Once the number of partial image carriers has been decided then the location and orientation of each of the partial image carriers 1210 and 1220 is chosen based on the artistic design requirements mentioned above. Once the location and orientation of the partial image carriers 1210 and 1220 is decided, then using standard drafting techniques, the complete image, "X" on the complete image 1200, is transferred onto partial image carriers 1210 and 1220. Two parts of the complete image 1200, a right side demarcated by the letters ABCD and a left side demarcated by the letters CDEF are shown divided by a line roughly in the middle. Once that is completed, the software automatically calculates the exact dimension of each and every partial image carrier together with the positioning (X and Y offsets from point of origin O (0,0)) of any desired point on the partial image carriers 1210 and 1220 that is necessary for any average construction person to be able to erect partial image carriers 1210 and 1220 using simple construction tools like a tape measure and a carpenters level.

Using the information provided by the software the following is a method of actual construction of the partial image carriers 1210 and 1220.

Using the lengths A1B1, B1C1,C1D1, D1A1 and angles A1B1C1, B1C1D1, C1D1A1 and D1A1B1 partial image carrier 1210 may be manufactured using a standard piece of plywood. The part of the complete image 1200 is drawn on the partial image carrier 1210 using the same method.

The same method is used to manufacture partial image carrier 1220.

Stationing of Point A1 on partial image carrier 1210 is provided by the software and is located on the ground a distance X1 from origin O (0,0l).

The manufactured partial image carrier 1220 is stood up and its corner is placed at point A1.

The beginning of a tape measure is placed at the point of origin O and extended towards point D1 of partial image carrier 1210. The other end of the tape measure is marked at the length X2.

Partial image carrier 1210 is swung around until it meets the marking X2 on the tape measure from the point of origin O and point D1 is located at the point where both D1 on partial image carrier 1210 and the marking X2 on the tape measure meet.

For simplicity, partial image carrier 1210 is stood up perpendicular to the ground.

Using the same method partial image carrier 1220 is manufactured and stood up with side E1H1 on the ground at the designed location.

Point X4 is located on the ground.

The beginning of a tape measure is placed at point X4 and marked at length Y4.

The tape measure is then pulled vertically using a carpenter's level while partial image carrier 1220 is being tilted back until point F1 on partial image carrier 1220 meets the marked length Y4 which determines the location of point F1 and the angle of tilt of partial image carrier 1220.

The partial images 130 could either be painted directly on the partial image carriers 1210 and 1220 or reproduced by computer, printed and then permanently or releasably fixed to the partial image carriers 1210 and 1220.

The above is accomplished using very basic construction tools, but could also be accomplished using highly advanced survey equipment as for example the electronic computerized transit where all the above information could be stored in the base transit unit stationed at the point of origin O (0,0), and any point whatsoever on the partial image carriers 1210 and 1220 could very easily be located using the reflector receiver that receives the signal from the base unit. So basically, one would place a big piece of plywood on the ground. Then the receiver may be programmed to locate point H1 and the surveyor would keep moving the receiver until it beeps and locates point H1. The corner of the piece of plywood may be placed at point H1 and the same may be done for point E1 and the piece of plywood is swung around to that point. Once the base of the partial image carrier 1220 is located, the receiver is programmed to locate point F1 or G1 and the board is tilted until it gets to the location the receiver pointed to. The above is very basic survey work that is normally done on a daily basis by any average surveyor.

If the display is designed for indoor use on a small scale to be mounted on a wall for instance, then the whole display could also be manufactured in pieces in a factory and reassembled on site and mounted on any wall be means of screws, bolts or any other applicable construction means.

The parts of the display 100 of the present invention could either be manufactured and constructed on site at the desired location or pre-manufactured elsewhere and assembled on site.

The display 100 of the present invention provides enhanced capture of observer attention and stirs observer curiosity of what is yet to come. The display 100 further garners increased observer attention span. Additionally, the display 100 achieves increased post exposure message retention by the observer.

The display 100 of the present invention, by its irregular artistic shapes and unusual orientations, will inspire observer curiosity. The observer may initially think the display 100 is modern art. The curiosity will build (as the observer wonders what the display 100 is) and hold their attention from initial notice until the moment of message presentation at the predetermined viewing area, and long after as the message disappears. The resulting increased period of focused observer attention together with the unique presentation method will result in enhanced message retention.

The present invention provides an advertising system for displaying a visual complete image and is particularly useful in settings where a large number of people are in motion relative to the display 100 such as walking or driving by.

What is claimed is:

1. A display comprising: a plurality of partial image carriers spatially positioned and oriented relative to each other in such manner that partial images mounted to each of said partial image carriers form a visually coherent, composite image when viewed from a predetermined angle, and wherein said partial images mounted to each of said partial image carriers remain visually incoherent and do not form a visually coherent, composite image when viewed from any angle other than said predetermined angle, each partial image carrier having a bottom edge and at least one partial image carrier having its bottom edge disposed above the bottom edge of at least one of the other partial image carriers; wherein at least two of said partial image carriers are oriented in planes that are not parallel to each other, and wherein each partial image carrier has a perimeter edge, the majority of each said perimeter edge being spaced apart from the perimeter edges of the other partial image carriers.

2. The display according to claim 1, wherein the partial images are two dimensional.

3. The display according to claim 1, wherein the partial image carriers are three dimensional.

4. The display according to claim 1, wherein the visually coherent, composite image defines a solid final image.

5. The display according to claim 1, wherein the visually coherent, composite image defines an outlined final image.

6. The display according to claim 1, wherein at least one of the partial image carriers is disposed on the ground.

7. The display according to claim 1, wherein a first set of partial image carriers are disposed on the ground and a second set of partial image carriers are disposed above the ground.

8. The display according to claim 1, wherein the partial image carriers are disposed above the ground.

9. The display according to claim 1, wherein the partial image carriers are supported by a support means.

10. The display according to claim 9, wherein the partial image carriers are adjustably supported by the support means.

11. The display according to claim 1, wherein the completed image defines an advertising image.

12. The display according to claim 1, wherein the display is disposed outdoors.

13. The display according to claim 1, wherein the display is disposed indoors.

14. The display according to claim 1, wherein the partial image carriers are prefabricated.

15. The display according to claim 1, wherein the partial image carriers are manufactured on site.

16. The display according to claim 1, wherein the partial images are releasably mountable to the partial image carriers.

17. A method of displaying a visually coherent, composite image comprising the steps of:

providing a plurality of partial image carriers;

providing a partial image mountable to each of the partial image carriers positioning said partial image carriers relative to each other in such manner that a bottom edge of at least one partial image carrier is disposed above a bottom edge of at least one of the other partial image carriers;

positioning said partial image carriers relative to each other in such manner that at least two of said partial image carriers are oriented in planes that are not parallel to each other;

positioning said partial image carriers relative to each other in such manner that the majority of a perimeter edge of each partial image carrier is spaced apart from perimeter edges of the other partial image carriers;

positioning said partial image carriers relative to each other in such manner that when said partial images are mounted to said partial image carriers, they together form a visually coherent, composite image when viewed from a predetermined angle, but when viewed from any other angle they remain visually incoherent and do not form a visually coherent, composite image.

* * * * *